United States Patent [19]

Davis

[11] 4,261,618

[45] Apr. 14, 1981

[54] DEVICE FOR BREAKING ICE AND COMPACTED SNOW ON ROAD SURFACES

[76] Inventor: Richard P. Davis, Perley Rd., Sanbornton, N.H. 03269

[21] Appl. No.: 82,323

[22] Filed: Oct. 5, 1979

Related U.S. Application Data

[63] Continuation of Ser. No. 909,375, May 25, 1978.

[51] Int. Cl.[3] ..... E01H 5/09

[52] U.S. Cl. ..... 299/25; 299/40

[58] Field of Search ..... 299/25, 39, 40; 172/599, 601, 558, 563, 537, 539, 556; 404/122, 124, 128, 132

[56] References Cited

U.S. PATENT DOCUMENTS

| | | | |
|---|---|---|---|
| 1,330,531 | 2/1920 | Haynes | 404/128 X |
| 1,570,582 | 1/1926 | Thompson | 172/601 X |
| 2,319,520 | 5/1943 | Rypkema | 299/25 |
| 2,736,254 | 2/1956 | Kropp | 172/556 X |
| 2,805,534 | 9/1957 | Robertson | 172/558 |
| 2,858,757 | 11/1958 | Davies | 172/601 |

*Primary Examiner*—Ernest R. Purser
*Attorney, Agent, or Firm*—Witherspoon & Hargest

[57] ABSTRACT

A device intended to be mounted on a vehicle and used for breaking up ice and compacted snow on road surfaces or similar surfaces. A number of breaker disks are mounted side by side on a common shaft which is supported cross-wise on the vehicle. The disks are rotatable and roll in the direction of travel of the vehicle. The shaft is movable up and down and can also tilt from side to side to some extent. Yielding down pressure is applied to the shaft by a hydraulic cylinder. In one form of the device, stationary clean out fingers are mounted between the disks. The disks are spaced apart by gaps of from one to four times the thickness of the disks.

4 Claims, 7 Drawing Figures

DEVICE FOR BREAKING ICE AND COMPACTED SNOW ON ROAD SURFACES

This is a continuation of application Ser. No. 909,375 filed May 25, 1978.

This invention relates to snow and ice removal devices, and more particularly to devices intended to be mounted on a vehicle such as a truck and used to break up ice and compacted snow on highways, parking lots, airport runways and similar areas. The invention here disclosed is an improvement on that disclosed in my U.S. Pat. No. 3,736,028, dated May 29, 1973, entitled ICE AND SNOW REMOVAL MACHINE.

BACKGROUND OF THE INVENTION

Plows of the scraper or rotary type ordinarily used to clear snow from roads, parking lots, airport runways and similar areas tend to leave a film of snow which becomes compacted by traffic or melts and refreezes as ice, once the film has hardened, a plow is not effective to remove it. It is customary to spread a mixture of sand and salt on the film to make the surface less slippery and induce melting. This practice is expensive and has other objectionable results. The accumulation of sand must be swept up after the winter season. The salt is damaging to vehicles travelling over the surface, and runoff of salt water is injurious to grass, trees, and shrubbery adjacent to the area.

The principal object of this invention is to provide a device which can be mounted on a truck or similar vehicle, and which mechanically breaks up ice and compacted snow so that the loosened material can be removed by a plow or sweeper, thus eliminating the need for salt and sand. Another object is to provide a device which breaks up the compacted film without damaging the road surface. Other objects, advantages and novel features will be apparent from the following description.

SUMMARY

The ice and snow breaking device here disclosed uses a set of breaker disks mounted side by side on a common shaft and separated by gaps. The ratio of the thickness of the disks to the width of the gaps is an important consideration. A ratio of disk thickness to gap width of from one to one to one to four has been found effective. The shaft is mounted cross-wise on a vehicle and the disks roll in the direction of travel of the vehicle. The shaft is carried by a yoke which is rotatable supported by a sleeve so that the yoke and shaft assembly can tilt to accomodate changes in contour of the road surface. The whole assembly is movable up and down with respect to the vehicle and one or more hydraulic cylinders secured to the vehicle exert a yielding down pressure on the breaker assembly.

DESCRIPTION OF THE PREFERRED EMBODIMENT

Figure 1:
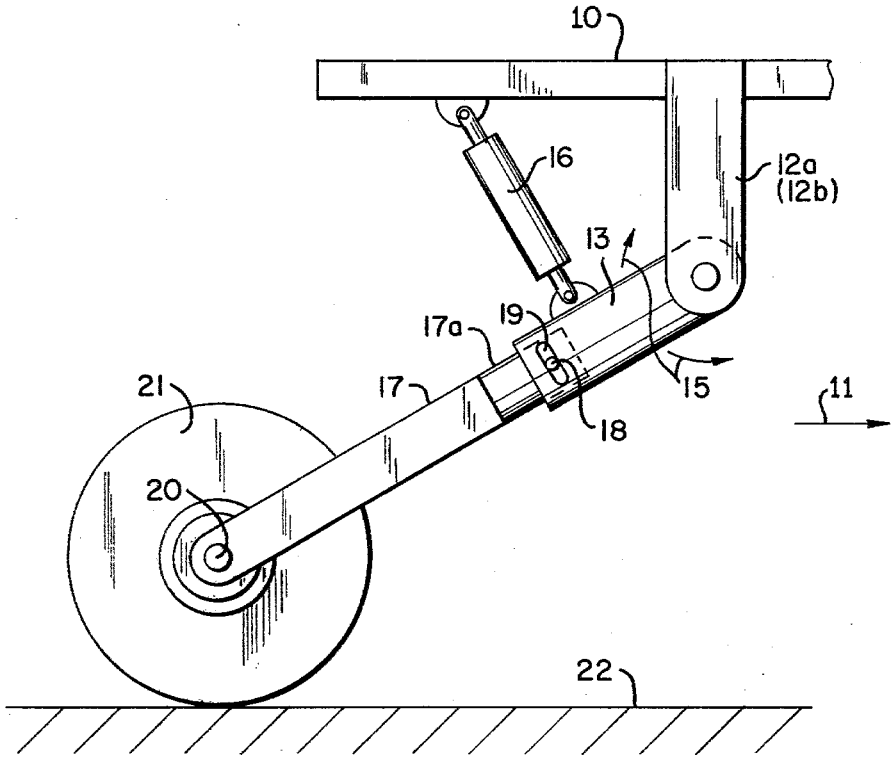
FIG. 1 is a side elevation of a device constructed according to the invention.
Figure 2:
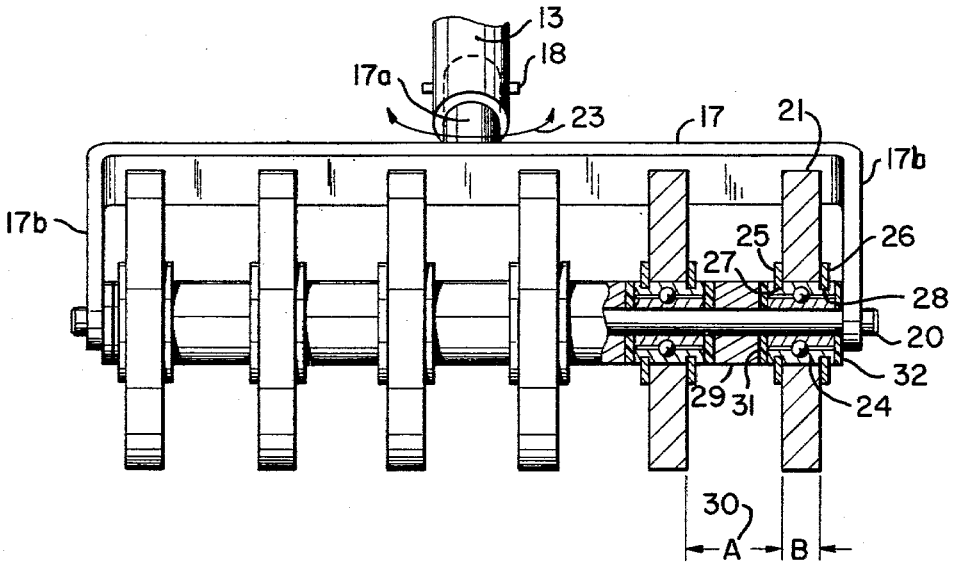
FIG. 2 is a plan view of the device shown in FIG. 1, the disks being shown partly in cross section.

The breaking device shown in FIGS. 1 and 2 is secured to a rigid member 10, carried by a suitable vehicle (not shown). This member may, for example, be a longitudinal chassis member of a truck or towed vehicle, or a separate support fixed to the vehicle in any suitable manner. The device may be mounted under, or in front or to the rear of the vehicle. The vehicle travels in the direction of arrow 11. A pair of brackets **12*a* and 12*b* are secured to member 10. A tubular sleeve is mounted on a shaft 14 supported by the brackets and is rotatable in a vertical plane in the direction of arrows 15. Movement of the sleeve is controlled by a hydraulic cylinder 16, of either the air or the liquid type, secured to the sleeve and to member 10**.

A yoke 17 has a tongue **17*a* which is rotatably received in sleeve 13 and secured by a pin 18 extending into slots 19. The yoke has arms 17*b* which carry a shaft 20 disposed cross-wise to the direction of travel of the vehicle. A number of breaker disks 21 are mounted side by side on the shaft and roll in the direction of travel of the vehicle. When the device is in use, the disks engage the road surface 22. A predetermined amount of pressure is applied to the disk assembly in the downward direction by cylinder 16**. The assembly can be raised out of action by retracting the cylinder. It is understood that advancement and retraction of the cylinder, and the down pressure applied, are controlled by a suitable pressure regulating system (not shown).

A typical mounting arrangement for the breaker disks is shown in FIG. 2. Each disk is mounted on the outer race of a ball bearing 24 which is mounted on shaft 20. The disk is held in place laterally by snap rings 25 and 26 set in grooves 27 and 28 in the bearing. The bearings are spaced from one another by Teflon seals 31 and 32 and spacer rings 29 so that gaps 30 are created between the disks.

The seals and spacer rings are of such a thickness that the width A of the gaps is in the range of one to four times the thickness B of the disks. The ratio of gap width to disk thickness is a significant feature of the invention. The compacted or frozen material which is engaged by a disk tends to fracture and move sidewise, carrying with it the material between the disks. If the disks are too close together, so that the disk assembly approaches in contout a solid cylinder, the material under the disk cannot readily move sidewise, and excessive pressure is required to fracture the material. If the disks are too far apart, the material between the disks will not be completely fractured. A disk thickness of one half inch combined with a gap width of one and one quarter inches has been found to produce satisfactory results under typical conditions.

Figure 3:
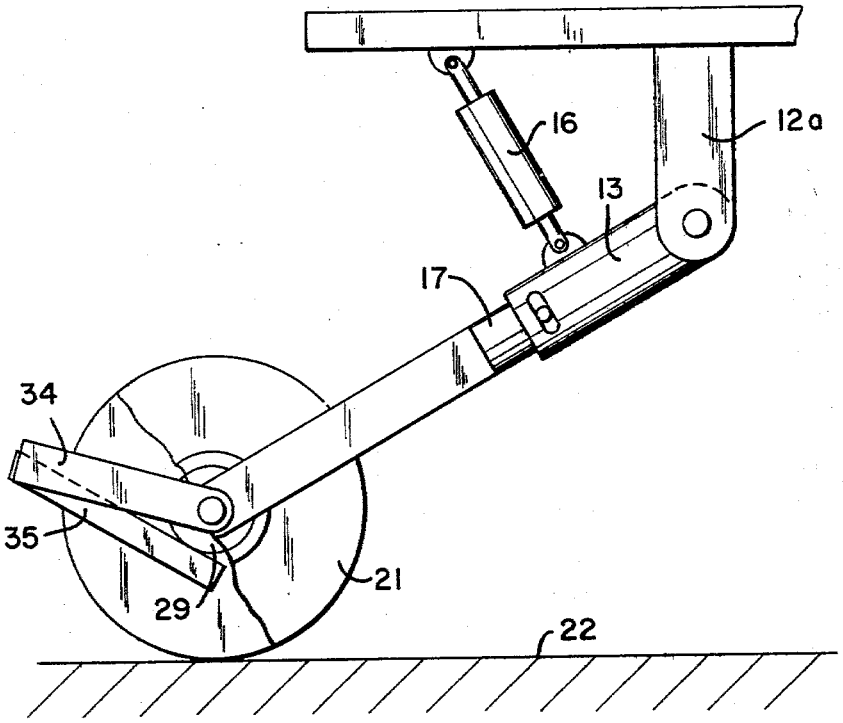
FIG. 3 is a side view, partly broken away, of a modified form of the devices.
Figure 4:
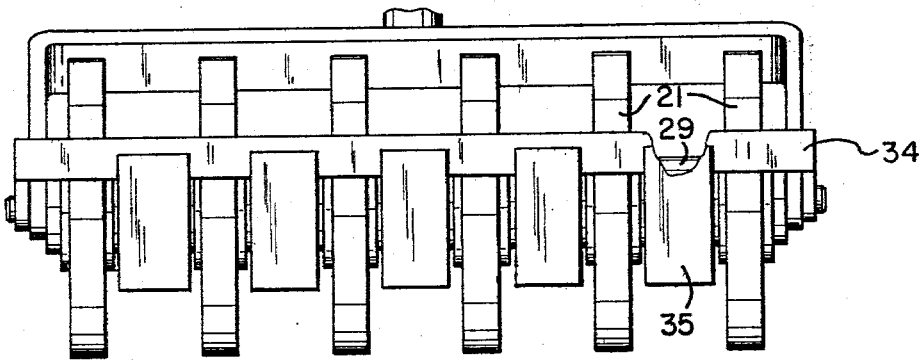
FIG. 4 is a rear elevation of the device shown in FIG. 3.

The device shown in FIGS. 3 and 4 is similar in all respects to that shown in FIGS. 1 and 2, except that a cleanout finger assembly has been added. This assembly consists of a U-shaped frame 34 fixed to arms **17*a* and 17*b*, supporting a number of fingers 35 disposed in the gaps between the disks 21. The fingers extend into the gaps between the disks under, and close to, the spacer rings 29**. The fingers serve to scrape out snow and ice as the disks roll, and prevent accummulation of material which might freeze up when the device is standing still.

Figure 5:
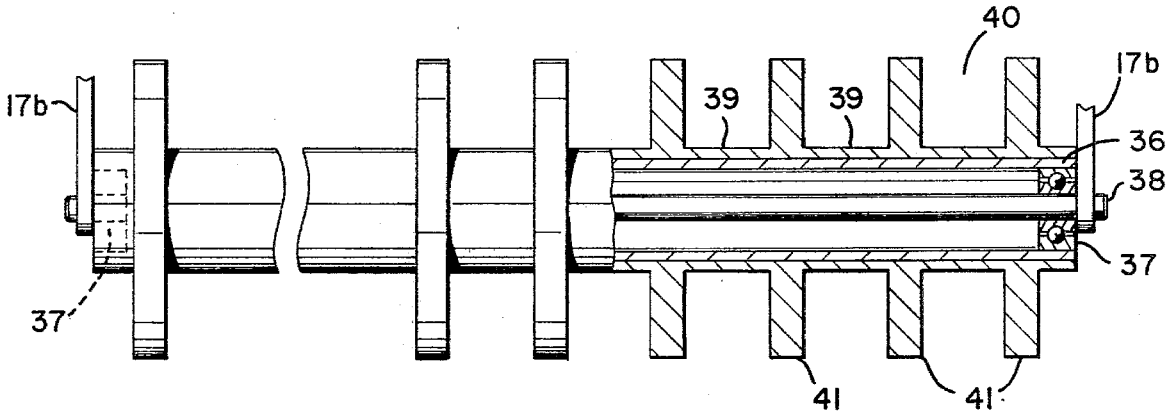
FIG. 5 is a fragmentary view, partly in cross-section, illustrating a modified form of the shaft and disk assembly.

FIG. 5 Illustrates an alternative construction of the disk and spacer assembly. A tube 36 is mounted on bearings 37 on a shft 38. It is understood that the shaft is supported by a yoke assembly which is mounted and controlled on a vehicle as previously described. The disks and spacers are cast or molded as an integral unit, which is mounted on tube 36. The spacers 39 create gaps 40 between the disks 41. The ratio of the width of gaps 40 to the thickness of disks 41 is in the range of one to one to four to one, for the reasons previously described..

Figure 6:
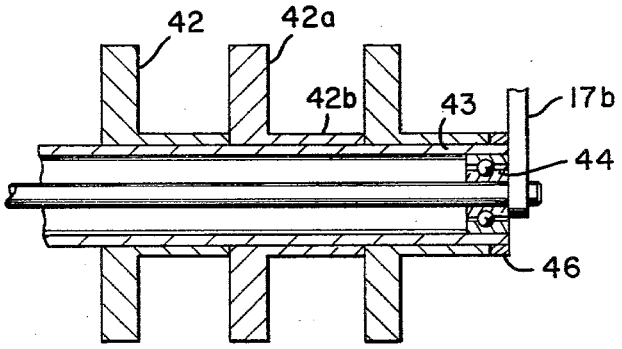
FIG. 6 is a fragmentary view, partly in cross-section, illustrating another modification of the shaft and disk assembly.

In the modification of the disk assembly shown in FIG. 6, the disk and spacer elements 42 are members of L-shaped cross-section, each having a radially extending flange 42*a* forming the disk and an axially extending hub 42*b* forming the spacer. The elements 42 are mounted on a tube 43, which is in turn mounted on bearings 44 disposed on a shaft 45. The spacer and disk elements are disposed in abutting relationship, and the assembly is held together laterally by end rings 46. Again, the shaft is mounted and controlled in the same manner as in the embodiments previously described, and the ratio of gap width to disk thickness is the same.

Figure 7:
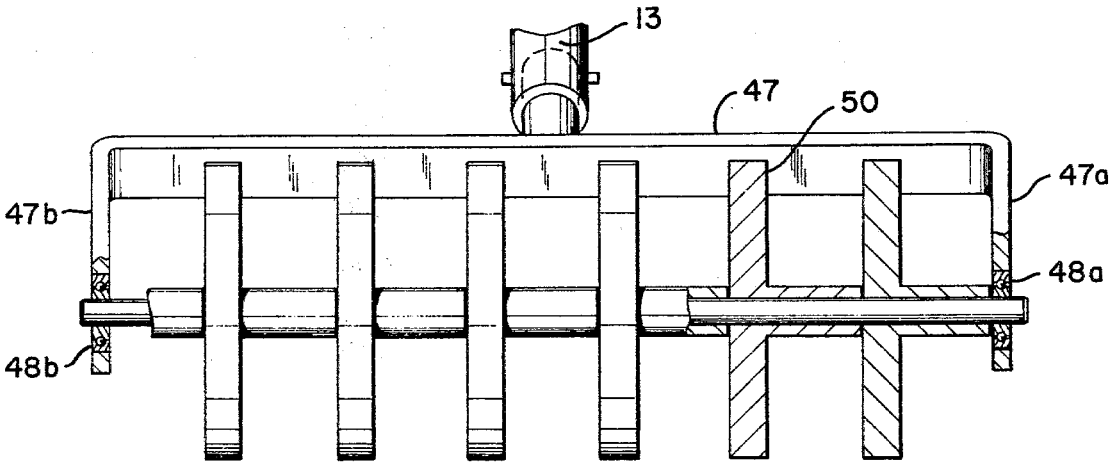
FIG. 7 is a plan view, partly in cross-section of a modification of the shaft and yoke assembly.

Another mounting arrangement for the disk assembly is shown in FIG. 7. A yoke 47, which is similar to yoke 17 and is mounted on the vehicle in the same manner has ball bearings 48*a* and 48*b* mounted in it arms 47*a* and 47*b*. A shaft 49 is mounted in the bearings and is thus rotatable with respect to the yoke. Disk and spacer elements 50, similar to elements 42, are mounted on the shaft.

The disks may be made of hardened steel or rigid, wear resistant plastic. The pressure required on the disk assembly varies with the diameter and thickness of the disks, as well as the number of disks. For example, a down pressure of three hundred pounds per disk on an assembly of twelve inch diameter disks each one half inch thick has been found adequate. The pressure required per disk is less for disks of smaller diameter or thickness. The vehicle can be weighted if necessary, so that its drive wheels maintain traction when pressure is applied to the disk assembly by the hydraulic system.

The device is effective at both high and low speeds of travel, so that it is adaptable for clearing both long stretches of highway and more confined areas such as parking lots.

What is claimed is:

1. Apparatus adapted for mounting on a vehicle for breaking up ice and compacted snow on a surface as the vehicle travels thereover, said apparatus comprising a shaft, means for mounting said shaft on a vehicle, said means comprising support means secured to the vehicle, a tubular bearing member attached to said support means whereby the tubular bearing member may swing fore and aft in the direction of travel of the vehicle, a yoke having a pair of arms connected to the ends of the shaft, a bearing rod affixed centrally to and extending outwardly from the yoke and rotatably fitting in the tubular bearing member whereby the bearing rod may rotate within said tubular bearing member and provide the shaft with corresponding motion through the yoke supporting said shaft, a plurality of disks mounted on the shaft for independent rotation thereon, means connected to the tubular bearing member to raise and lower the shaft with respect to the vehicle and to provide requisite pressure on the surface engaged by the disks, spacer means positioned between the respective disks to maintain specific spacing therebetween in the range of 1 to 4 times the thickness of a single disk, and a cleanout finger assembly attached to the respective arms of the yoke, said assembly comprising a U-shaped frame having its leg end portions affixed to the respective arms of the yoke whereby the U-shaped frame extends rearwardly opposite to the direction of travel of the vehicle, cleanout fingers attached to the body of the U-shaped frame, said fingers having a width greater than ½ of the space between adjacent disks and extending forwardly in the direction of vehicle travel and terminating immediately below and adjacent the spacer means whereby ice and snow collected in and between the respective disks and spacer means will be scraped therefrom as the disks rotate to bring the ice and snow into engagement with the cleanout fingers below the level determined by a horizontal plane through the shaft parallel to the surface over which the apparatus is being drawn.

2. Apparatus adapted for mounting on a vehicle for breaking up ice and compacted snow on a surface as the vehcile travels thereover, said apparatus comprising a shaft, means for mounting said shaft on a vehicle, said means comprising support means secured to the vehicle, a tubular bearing member attached to said support means whereby the tubular bearing member may swing fore and aft in the direction of travel of the vehicle, a yoke having a pair of arms connected to the ends of the shaft, a bearing rod affixed centrally to and extending outwardly from the yoke and rotatably fitting in the tubular bearing member whereby the bearing rod may rotate within said tubular bearing member and provide the shaft with corresponding motion through the yoke supporting said shaft, a plurality of disks mounted on the shaft for independent rotation thereon, means connected to the tubular bearing member to raise and lower the shaft with respect to the vehicle and to provide requisite pressure on the surface engaged by the disks, spacer means positioned between the respective disks to maintain specific spacing therebetween in the range of 1 to 4 times the thickness of a single disk.

3. The invention as set forth in claim 2 and wherein the means connected to the tubular bearing member to raise and lower the shaft comrpises a hydraulic piston and cylinder arrangement.

4. The invention as set forth in claim 2 and wherein a cleanout finger assembly is attached to the respective arms of the yoke, said assembly including cleanout fingers having a width greater than ½ of the space between adjacent disks and extending forwardly in the direction of vehicle travel and terminating immediately below and adjacent the spacer means whereby ice and snow collected in and between the respective disks and spacer means will be scraped therefrom as the disks rotate to bring the ice and snow into engagement with the cleanout.

* * * * *